US008087677B2

(12) United States Patent
Bouttie

(10) Patent No.: US 8,087,677 B2
(45) Date of Patent: Jan. 3, 2012

(54) SNOW GLIDING BOARD AND SET OF AT LEAST TWO SUCH SNOW GLIDING BOARDS

(75) Inventor: Denis Bouttie, Chedde Passy (FR)

(73) Assignee: Skis Dynastar, Sallanches (FR)

( * ) Notice: Subject to any disclaimer, the term of this patent is extended or adjusted under 35 U.S.C. 154(b) by 517 days.

(21) Appl. No.: 12/269,091

(22) Filed: Nov. 12, 2008

(65) Prior Publication Data

US 2009/0160161 A1 Jun. 25, 2009

(30) Foreign Application Priority Data

Dec. 20, 2007 (FR) ..... 07 60169

(51) Int. Cl.

| | |
|---|---|
| ***A63C 1/00*** | (2006.01) |
| ***A63C 5/07*** | (2006.01) |
| ***A63C 5/04*** | (2006.01) |
| ***A63C 5/02*** | (2006.01) |

(52) U.S. Cl. ..... 280/11.15; 280/602; 280/607; 280/608; 280/609; 280/610

(58) Field of Classification Search ..... 280/11.12, 280/600, 601, 602, 603, 607, 608, 609, 610, 280/11.15, 11.18; 441/68, 74, 76
See application file for complete search history.

(56) References Cited

U.S. PATENT DOCUMENTS

| | | | | |
|---|---|---|---|---|
| 3,096,530 | A * | 7/1963 | Almgren | 441/70 |
| 3,825,360 | A * | 7/1974 | Galich | 403/294 |
| 3,899,186 | A * | 8/1975 | Matsuda | 280/607 |
| 4,129,911 | A * | 12/1978 | McDonald et al. | 441/74 |
| 4,155,568 | A * | 5/1979 | Galich | 280/603 |
| 4,458,912 | A * | 7/1984 | Bertonneau | 280/603 |
| 4,593,926 | A * | 6/1986 | Pergola | 280/603 |
| 4,697,820 | A * | 10/1987 | Hayashi et al. | 280/609 |
| 4,844,499 | A * | 7/1989 | Baumann | 280/603 |
| 5,498,016 | A * | 3/1996 | Jodelet | 280/602 |
| 6,478,917 | B1 | 11/2002 | Magoni et al. | |
| 7,055,846 | B2 * | 6/2006 | Restani | 280/607 |
| 7,404,564 | B2 * | 7/2008 | Bregeon et al. | 280/14.21 |
| 2001/0022439 | A1 * | 9/2001 | Andrus et al. | 280/610 |
| 2003/0085549 | A1 * | 5/2003 | Gorza et al. | 280/607 |
| 2003/0146599 | A1 | 8/2003 | Stefanova et al. | |
| 2005/0206130 | A1 * | 9/2005 | Parten | 280/610 |
| 2007/0108733 | A1 * | 5/2007 | Heil et al. | 280/602 |
| 2007/0170694 | A1 * | 7/2007 | Adamczewski et al. | 280/607 |
| 2007/0296181 | A1 * | 12/2007 | Alary et al. | 280/601 |
| 2008/0029998 | A1 * | 2/2008 | Largueze et al. | 280/607 |
| 2008/0029999 | A1 * | 2/2008 | Lee | 280/609 |
| 2008/0238040 | A1 * | 10/2008 | Avgustin et al. | 280/601 |
| 2009/0230658 | A1 * | 9/2009 | Fournier | 280/607 |

FOREIGN PATENT DOCUMENTS

| | | | |
|---|---|---|---|
| DE | 20 2005 017828 | U1 | 2/2006 |
| EP | 0 774 280 | A1 | 5/1997 |

(Continued)

*Primary Examiner* — John R Olszewski
(74) *Attorney, Agent, or Firm* — Burr & Brown

(57) ABSTRACT

A snow gliding board includes an upper protective layer and an internal mechanical structuring beam. The upper protective layer partially covers the internal beam, without significantly influencing the mechanical behavior defined by the internal beam while also including a visible skin, and a 3D visible decorative element which projects above the skin while being fixed in a cutout perforated in the visible skin.

17 Claims, 3 Drawing Sheets

FOREIGN PATENT DOCUMENTS

| | | | |
|---|---|---|---|
| EP | 0 972 544 | A1 | 1/2000 |
| EP | 1 314 459 | A1 | 5/2003 |
| FR | 2 540 391 | A1 | 8/1984 |
| FR | 2 823 126 | A1 | 10/2002 |
| FR | 2 873 591 | A1 | 2/2006 |

* cited by examiner

SNOW GLIDING BOARD AND SET OF AT LEAST TWO SUCH SNOW GLIDING BOARDS

FIELD OF THE INVENTION

The present invention relates to the field of snow sports, such as downhill skiing or snowboarding. More precisely, it relates to a snow gliding board, and to a set of at least two such snow gliding boards.

BACKGROUND OF THE INVENTION

Conventionally, a snow gliding board has an internal structure which defines its mechanical behavior and which comprises a longitudinal core and one or more reinforcements, for example a lower reinforcement and an upper reinforcement disposed on either side of this core. The internal structure of the gliding board is protected by a covering. In particular, its bottom and its top are lined respectively with a sliding base and an upper protective layer, which is visible and generally decorative.

Conventionally, this upper protective layer consists of an outer skin or film, which is made from a single material or has the form of a multimaterial complex. In general, the upper reinforcement of the internal structure extends against this outer skin, the shape of which determines its own.

In this respect, the outer appearance of the top of the gliding, board and, in particular, its shape, are often selected according to aesthetic considerations. This shape of the top of the gliding board determines that of the outer skin of the upper protective layer. Usually, as described above, the shape of this outer skin in turn determines that of the upper reinforcement.

In short, in most present-day gliding boards, the final shape of the upper reinforcement often results from non-technical considerations, whereas it influences the mechanical properties defined by this upper reinforcement.

In other words, the consideration of aesthetic factors affecting the shape of the top of a snow gliding board generally constitutes an additional technical constraint, which must be taken into account when designing the snow gliding board. In particular, once the shape of the snow gliding board is modified for aesthetic reasons, a new analysis of the internal structure of this board must usually be carried out and usually leads to a new definition of this internal structure.

Any technical study, any new development and any new fabrication incurs costs, including those associated with the reference listing and storage of different elements, albeit intended to perform similar functions in several ranges of gliding boards.

To avoid such costs, it is known to place a pad, inert or not, between the upper reinforcement and the skin of the upper protective layer. However, the hot shaping of this skin in a mold, during the fabrication of the gliding board, may be accompanied by appearance defects, such as deformations, cracks and/or shifts of the printed motifs, above the pad, insofar as this pad has a significant size.

Document FR-2 873 591 proposes to make a cutout in the upper protective layer of a snow gliding board and to place therein an insert defining a gripping zone of the gliding board. The insert material may be a rubber. In fact, it is selected to facilitate the gripping of the gliding board. For the same purpose, this gliding board has undulations for inserting the fingers of a hand, at the insert, which has a constant thickness, substantially equal to that of the upper protective layer.

Document FR-2 823 126 describes a method for fabricating a snow gliding board of which an upper protective layer includes an insert. This insert has substantially the same thickness as the upper protective layer, to avoid projecting beyond it once accommodated in a cutout made in this upper protective layer.

In document EP-0 774 280, a window cut out in an upper protective layer of a ski is closed by an added plastic part. Beyond the edge of the window, this plastic part passes below the upper protective layer and forms a pad in relief toward the interior of the ski.

Document FR-2 540 391 describes a downhill ski board of which the top is defined, in particular, by a protective skin perforated with two cutouts. At each of these two cutouts, a sandwich structure is placed, particularly a reinforcement which has the essential function of significantly affecting the mechanical behavior of the gliding board. The reinforcement of this sandwich structure extends against an outer protective skin whereof it follows the profile. In this way, a modification of the shape of the top of the gliding board at the abovementioned cutouts is reflected by a modification of the mechanical behavior of the gliding board as if it were not offset by a new design of the elements defining the mechanical behavior of the gliding board. Here also, a modification of the shape of the top of the ski board, for simply aesthetic reasons, cannot be made easily without incurring substantial costs.

Furthermore, each sandwich structure added to the board described in FR-2 540 391 is such that its fabrication mode is similar to that of a complete snow gliding board and therefore has the same drawbacks, particularly in terms of complexity and limited possible shapes.

SUMMARY OF THE INVENTION

It is at least one object of the invention to facilitate a modification of the outer appearance of the top of a gliding board and, more precisely, of the shape of such a top.

According to the invention, this object is achieved thanks to a snow gliding board comprising at least edges and a base of a lower assembly, an internal mechanical structuring beam and an upper protective layer, which partially covers the internal beam without significantly influencing the mechanical behavior defined by the internal beam, while further including a visible skin perforated with a cutout. The upper protective layer comprises at least one 3D visible decorative element which projects above the skin, while being fixed in the cutout so as to close the cutout and to be flush with the underside of the skin, with at least the skin and the 3D decorative element together defining a 3D visible top of the gliding board.

The shape of the top of the gliding board defined above may be easily modified, without changing the definition of the internal beam and therefore without any significant change in the behavior of the gliding board, particularly by replacing the 3D decorative element of the upper protective layer by another decorative element of a different shape.

Advantageously, an upper face of the internal mechanical structuring beam comprises a portion which has a predefined shape and that is above where the cutout is located, the 3D decorative element includes a lower face substantially matching the predefined shape. Advantageously, this predefined shape includes a cross section that is substantially straight. It may furthermore include a longitudinal section that is also substantially straight, in order to be substantially planar.

Advantageously, the mechanical structure beam includes at least one core, and an upper reinforcement which is at least directly under the 3D decorative element and extends substantially according to the predefined shape. As to this 3D decorative element, it may have a maximum thickness that is at least equal to three times the thickness of the skin.

Advantageously, the 3D decorative element defines a hollow recess for accommodating an added part. For example, the latter may be a decorative mask fixed permanently or interchangeable, of which the visual appearance may recall that of the skin and/or may personalize the gliding board.

Advantageously, the 3D decorative element forms a way for retaining an added part. Such retention may include a back draft which is located at an overhang that is intended to extend above a nesting tab or an equivalent portion of the added part.

Advantageously, the snow gliding board carries one accessory with at least a portion of which is enveloped by the 3D decorative element. In this way, a connection can be provided that participates in a harmonious integration of this accessory to the gliding board.

Advantageously, the 3D decorative element is over-molded on at least a portion of the accessory, which may in particular include a plate for supporting a binding for a boot, such as a ski boot or a snowboard boot.

The cutout may have a contour closed on itself, matching a contour of the decorative element. This cutout may also extend along the whole width of the gliding board and have an open contour, matching a contour of the decorative element. The decorative elementis substantially adjusted without any clearance in the cutout so that its underside may be flush with the underside of the skin constituting the upper protective layer, that is, located substantially at the same depth as the underside of the skin so as to prolong it, without extra thickness or other discontinuity.

Advantageously, the 3D decorative element is an injection molded part. Such a part has a low production cost, while possibly having complex shapes. For example, being injection molded, the decorative element may have back drafts and/or threads obtained during the molding and not by subsequent machining. It may also benefit from other possibilities offered by the injection molding technique. For example, the molded decorative element may be over-molded on an accessory of the gliding board or may be applied by a printing process routinely referred as "in-mold printing".

Advantageously, the 3D decorative element is a one-piece part made from a single material. It may also be a one-piece part made from a plurality of materials joined together via at least one interface.

Insofar as the reinforcements of the ski board all form part of the internal beam, the 3D decorative element has no reinforcement.

The invention also relates to a set of at least two gliding boards each as described above, which substantially include the same internal mechanical structuring beam and which are distinguished from one another in that the 3D decorative element of one of the gliding boards and the 3D decorative element of the other gliding board confer different shapes on the respective visible tops of these two gliding boards.

BRIEF DESCRIPTION OF THE DRAWINGS

The invention will be understood from a reading of the description as follows, provided exclusively as an example and in conjunction with the appended drawings, in which.

DETAILED DESCRIPTION OF THE INVENTION

Figure 1:
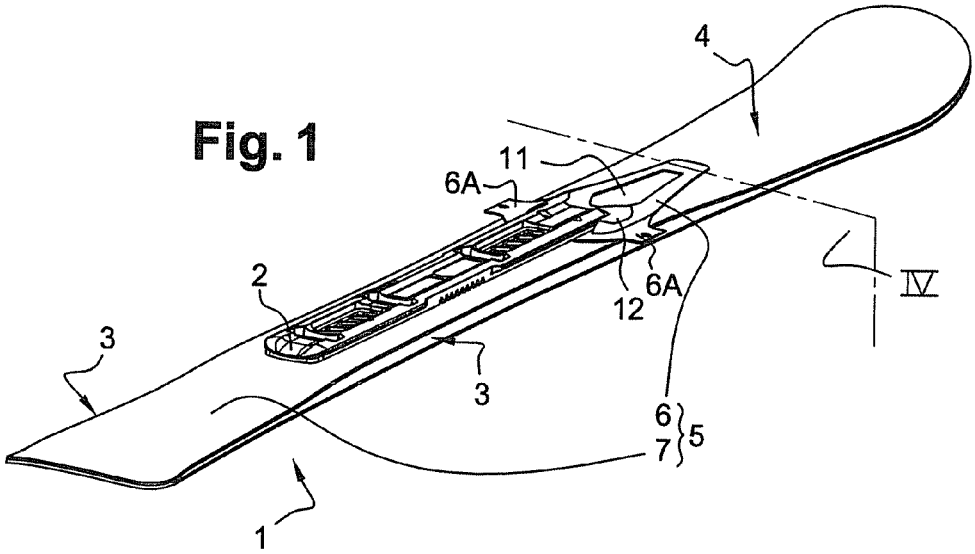
FIG. 1 is a perspective view of a ski board according to the invention.

FIG. 1 shows a downhill ski board 1 surmounted by a plate 2, for accommodating a binding for a ski boot. This ski board 1 includes a bottom, sides 3 and a top or upper face 4 defined by an upper protective layer 5 that may be decorative.

Figure 2:
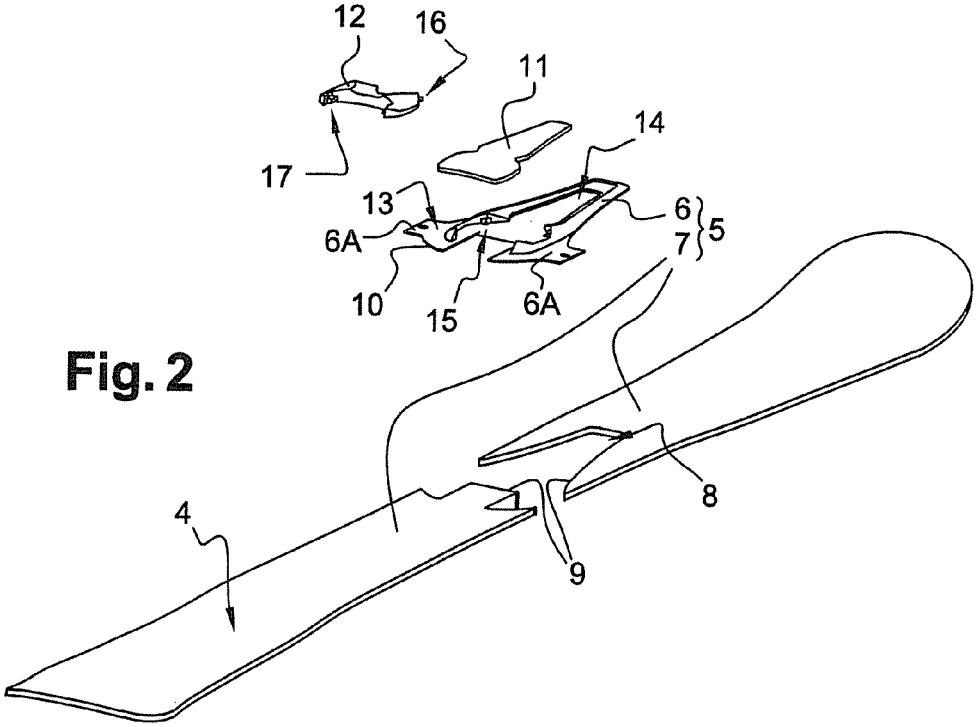
FIG. 2 is an exploded perspective view of an upper subassembly comprised by the ski board in FIG. 1 and which defines the top of this ski board.

As shown in FIG. 2, the upper protective layer 5 includes a plurality of assembled visible elements, including one 3D decorative element 6 and a skin or film 7 produced conventionally from a thermoplastic polymer. This polymer may be transparent or translucent, particularly if the underside of the skin 7 receives one or more coats of ink or varnish by printing or by any other appropriate means.

The skin 7 is perforated with a cutout or through opening 8, which extends along the whole width of the gliding board 1 and of which the contour 9 matches a peripheral contour 10 of the decorative element 6. Although it is open in the example shown, the contour 9 may also be closed.

FIG. 2 also shows two upper 11 and 12 accessories which, in FIG. 1, are carried by the decorative element 6 so as to be visible.

The accessory 11 is more precisely an added decorative plate, of which the motifs and/or inscriptions can be selected in order to form a harmonious combination with a décor carried by the skin 7 that include technical data, references and/or advertising. The accessory 11 may also be a hologram for reproducing the interior of a ski board and/or a technical element, for example a vibration damping element.

The accessory 12 also has a decorative function. In fact, it is an added connecting piece, which is also involved in the fastening of the decorative plate 11 in a manner described in detail below.

The decorative element 6 is a one-piece flexible part, which is injection molded from a single polymer or a plurality of polymers to be joined together via one or more common interfaces. Its underside is substantially planar, and has a substantially straight cross section. On the other hand, the upper face 13 of the decorative element 6 can be in relief. The decorative element 6 therefore, can have a variable thickness between its lower and upper faces, which may have different shapes.

Figure 3:
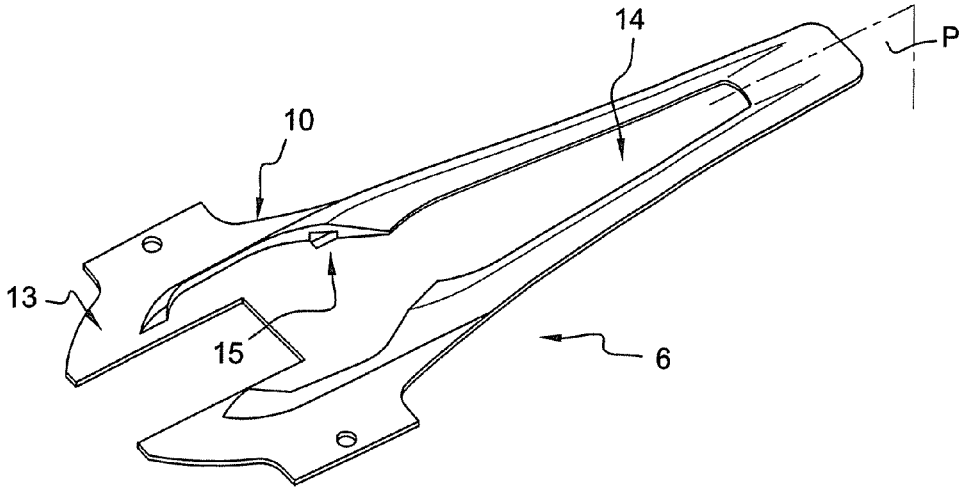
FIG. 3 is a perspective view of one of the elements shown in FIG. 2.

As can be observed in FIG. 3, the upper face 13 of the decorative element 6 bounds a hollow recess 14 for accommodating the decorative plate 11. The part 6 also bounds two locking holes 15 which are for assembling the connecting part 12 and which are disposed symmetrically to one another with regard to the plane of symmetry P extending along the length of the ski board 1. Each locking hole 15 is provided for the insertion of a tab for assembling the connecting part 12 and terminates in an edge of the hollow recess 14 in order to be bordered upward by an overhanging portion which is intended to retain the assembly tab, reference 16 in FIG. 2, and which has a back draft for this purpose.

The decorative plate 11 is fixed to the bottom of the hollow recess 14, for example by adhesive. Its rear portion is also retained between the decorative element 6 and the connecting part 12, which is secured in place by the insertion of the assembly tabs 16 in the holes 15 and also ribs referenced 17 in FIG. 2. The ribs 17 are intended to be trapped under the plate 2, which is the case in FIG. 1.

As may be observed in FIG. 1, the decorative element 6 and the connecting part 12 envelope the front portion of one edge of the plate 2, in order to protect the front of the plate 2 while making a harmonious connection between the skin 7 and the plate 2 for an aesthetic integration with the plate 2. The decorative element 6 may also serve for the harmonious integration of a part other than the plate 2.

Figure 4:
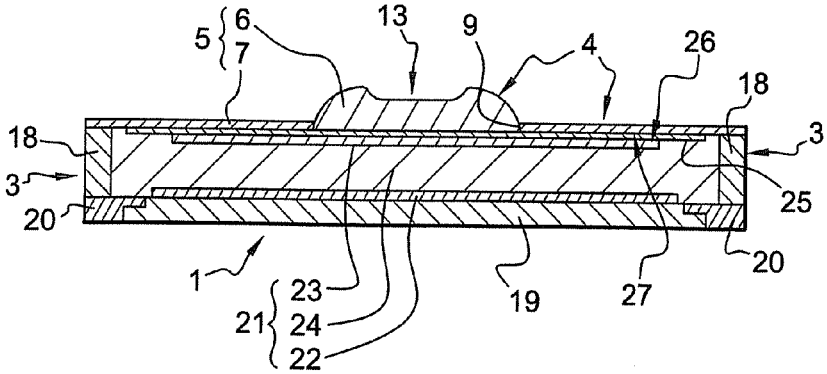
FIG. 4 is a schematic cross section along plane IV in FIG. 1, and shows the same ski board as this FIG. 1, but not in an exploded view.

The upper protective layer 5 forms part of the outer envelope of which an example is proposed in FIG. 4 and which surrounds and protects an internal structure of the ski board 1. In the example in FIG. 4, this outer envelope comprises two edges or left and right longitudinal walls 18. It also includes a bottom sliding base 19 and two left and right edges 20, which border the base 19 and of which each is surmounted by one of the longitudinal walls 18.

Inside the above envelope is an internal beam 21, that is a structural element in that it defines at least essentially the mechanical behavior of the ski board 1 and which, for this purpose, includes one or more reinforcements. In the example in FIG. 4, the reinforcements of the internal beam 21 are two in number. They include a lower reinforcement 22 and an upper reinforcement 23, each of which has a substantially straight cross section. Each of the reinforcements 22 and 23 of the internal beam 21 include a hardened matrix and a structure of interlaced reinforcing fibers in this hardened matrix, which may in particular be a polymerized resin. Each of the reinforcements 22 and 23 extends to a level lower than the skin 7, while remaining below the cutout 8.

The internal beam 21 also includes a core 24 which fills a space separating the reinforcements 23 and 23 from one another and which can in particular be made from expanded polyurethane foam or even from wood or from any other appropriate material.

The ski board 1 may be produced in various ways, for example by using one of the conventional methods for fabricating a snow gliding board in a mold, by hot molding. For example, when this board 1 is of the type with an injected core, the foam of its core 24 is expanded between the reinforcements 22 and 23 and, in doing so, applies the lower reinforcement 22 against the base 19 and the upper reinforcement 23 against the upper protective layer 5 and against a leak tight film 25, which extends at least on either side of the junction line between the decorative element 6 and the skin 7, in order to prevent any leakage of resin or polyurethane foam. In this way, the upper reinforcement 23 and the upper face 26 of the internal beam 21 have a predefined shape, which is substantially complementary to that of the underside 27 of the upper protective layer 5 and of which the cross section is substantially straight.

The board 1 may also have a sandwich structure without injected core, in which case the application of its various components against one another results from their clamping between the lower and upper parts of the mold, during the closure of this mold.

Regardless of the method employed by which the board 1 is fabricated the incorporation of the decorative element 6 can be simplified. More precisely, its cavity includes a recess which is designed to receive the emergent part of the decorative element 6 and which may have a much simpler shape than the decorative element 6 insofar as the latter already has a definitive shape resulting for example from its injection molding.

In this respect, the decorative element 6 has two perforated positioning wings 6A. When it is placed in the mold, it is handled by its wings 6A, thereby facilitating its accurate positioning, which are dissociated from the board 1 after the molding.

As may be observed in FIG. 4, the decorative element 6 closes the cutout 8, where it is fixed in order to form a projection above the skin 7. Thanks to this decorative element 6, the top 4 of the ski board 1 may have a 3D shape, with one or more projecting reliefs and/or one or more hollows, and have a non-straight cross section, even when the upper reinforcement 23 has a straight cross section. In other words, the top 4 and the upper reinforcement 23 may have different cross sections and, more generally, different shapes.

The shape of the upper face 26 of the internal beam 21 and that of the upper reinforcement 23 may be selected according to essentially technical considerations related to the desired mechanical behavior of the ski board 1, taking little or no account of the shape selected for the top 4 of this board 1. The shape of this top 4 is mainly determined by the decorative element 6 of the upper layer 5 which has the main function of protecting the internal beam 21 without significantly influencing the mechanical behavior of the ski board 1.

It is easy to change the shape of the top 4 of the ski board 1 without necessarily modifying the mechanical behavior of this board 1. For this purpose, the upper protective layer 5 is replaced by another having a decorative element similar to the one referenced 6 without having the same shape and/or without being located at the same place. The upper protective layer 5 may also be replaced by another having a plurality of decorative elements similar to the one referenced 6.

One way to benefit from the system discussed in the above paragraph is to design two or more ranges of boards 1 at low cost and to produce these two ranges, whereof the boards 1 substantially include the same internal beam 21 but not the same upper protective layer 5, so as to be distinguished from one another by the different shapes of their respective tops 4. The boards 1 of one of the two ranges, and the boards 1 of the other range, substantially have the same behavior on snow, while having very different appearances. Increasing the number of ranges of boards 1 by proceeding in this way has the advantage of generating only a slight extra cost.

Among the methods that can be used to insert the decorative element 6 in the cutout 8 are those described in documents EP-0 972 544, FR-2 823 126 and EP-1 479 416.

Figure 5:
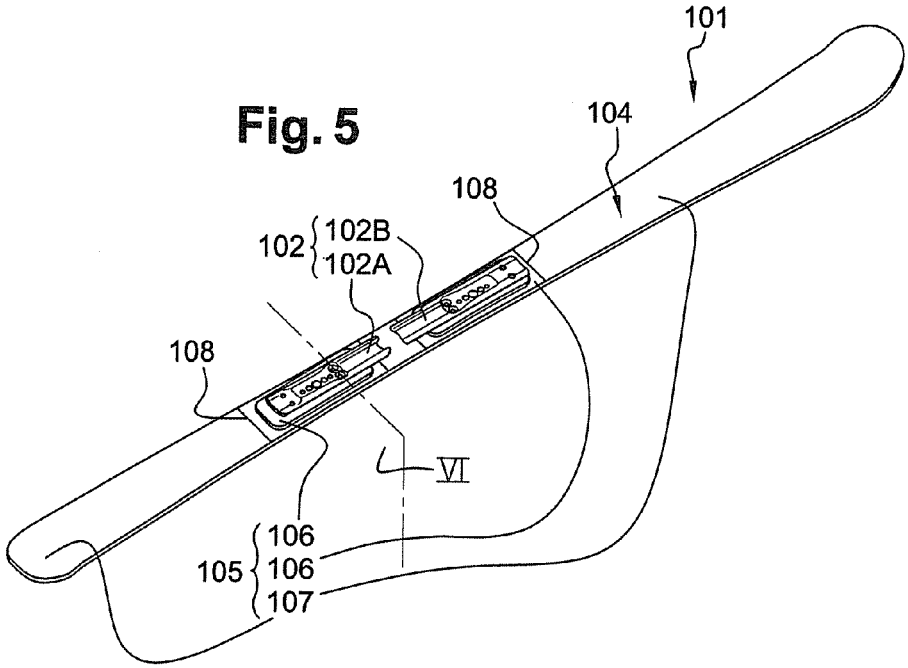
FIG. 5 is a view similar to FIG. 1 and shows a ski board according to an alternative embodiment of the invention.
Figure 6:
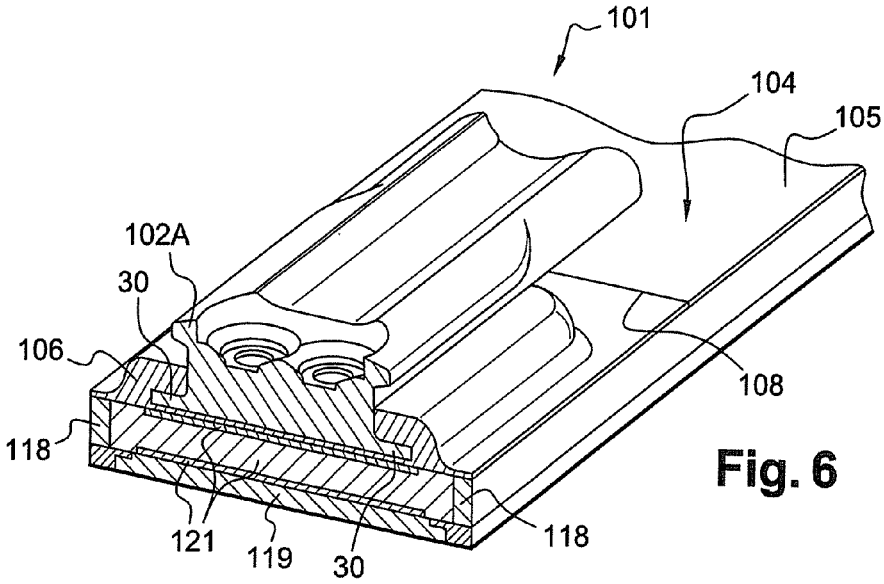
FIG. 6 is a perspective cross section view along plane VI in FIG. 5 and partially shows the same ski board as FIG. 5, but at a larger scale.

FIGS. 5 and 6 show a ski board 101 in an alternative embodiment of the invention. In the following discussion, only what distinguishes it from the ski board 1 is described. Furthermore, a reference used below to denote a portion of this board 101 similar or equivalent to a part referenced in the board 1 is constructed by adding 100 to the reference identifying this part in the board 1.

As may be observed in FIG. 5, the plate 102 is in two parts, which are a rail 102A and a rail 102B disposed in the prolongation of one another and whereof each is intended to accommodate a binding subassembly, such as a back heelpiece or a front toe piece not shown for the sake of clarity.

At the same time, the upper protective layer 105 includes two 3D decorative elements 106, each of which is housed without clearance in one of the two cutouts 108 arranged in the skin 107 of this upper protective layer 105. Each decorative element 106 carries and retains one of the rails 102A and 102B, while enveloping its bottom portion.

As may be observed in FIG. 6, one of the decorative elements 106 is over-molded on the bottom portion of the rail 102A, in order to imprison the assembly base, including two side and opposite wings 30 which form part of this base. Similarly, the other decorative element 106 is over-molded on the rail 102B.

The ski board 101 includes an internal beam 121 which is identical or substantially identical to the beam 21 and which is protected by an outer envelope that includes a plurality of elements connected in a sealed manner, including the upper protective layer 105, the base 119 and the two left and right edges 118.

Whereas the internal beam 121 is identical or substantially identical to the internal beam 21 of the board 1, the ski board 101 has a top 104 of which the appearance and, in particular, the shape differ from the top 4 of the board 1.

In the example shown, none of the decorative elements 106 carries an accessory similar to the decorative plate 11, or the connecting part 12 as this is not mandatory.

The invention is not limited to the embodiments described above. In particular, it is not limited to downhill ski boards. On the contrary, a snowboard, a crosscountry ski board or any other type of snow gliding board may also conform to the invention.

The invention claimed is:

1. A snow gliding board, comprising at least edges and a base of a lower assembly, an internal mechanical structuring beam and an upper protective layer, wherein the upper protective layer partially covers said internal beam without influencing the mechanical behavior defined by said internal beam, and comprising a visible skin perforated with a cutout extending along a whole width of the gliding board, wherein the upper protective layer further comprises at least one 3D visible decorative element which projects above said skin, while being fixed in said cutout so as to close said cutout and to be flush with the underside of said skin, with at least said skin and the 3D decorative element together defining a 3D visible top of the gliding board, and wherein said cutout has an open contour that matches a contour of the 3D decorative element.

2. The gliding board as claimed in claim 1, wherein an upper face of the internal mechanical structuring beam comprises a portion which has a predefined shape and above which said cutout is located, and wherein the 3D decorative element further comprises a lower face that substantially matches said predefined shape of said portion.

3. The gliding board as claimed in claim 2, wherein the internal mechanical structuring beam comprises at least one of a core, and an upper reinforcement, of which, at least directly under the 3D decorative element, extend substantially as said predefined shape.

4. The gliding board as claimed in claim 2, wherein said predefined shape comprises a cross section that is substantially straight.

5. The gliding board as claimed in claim 1, wherein the 3D decorative element has a maximum thickness that is at least equal to three times the thickness of said skin.

6. The gliding board as claimed in claim 1, wherein the 3D decorative element defines a hollow recess for accommodating an added part.

7. The gliding board as claimed in claim 1, wherein the 3D decorative element forms means for retaining an added part.

8. The gliding board as claimed in claim 7, wherein said retaining means comprises an undercut.

9. The gliding board as claimed in claim 1, wherein the gliding board carries at least one accessory of which at least a portion of said accessory is enveloped by the 3D decorative element.

10. The gliding board as claimed in claim 9, wherein the 3D decorative element is over-molded on at least a portion of said accessory.

11. The gliding board as claimed in claim 9, wherein said accessory comprises a plate for supporting a binding for a boot.

12. The gliding board as claimed in claim 1, wherein said cutout contour is closed and matches the contour of the 3D decorative element.

13. The gliding board as claimed in claim 1, wherein the 3D decorative element is an injection molded part.

14. The gliding board as claimed in claim 1, wherein the 3D decorative element is a one-piece part made from a single material.

15. The gliding board as claimed in claim 1, wherein the 3D decorative element is a one-piece part made from a plurality of materials joined together via at least one interface.

16. The gliding board as claimed in claim 1, wherein the 3D decorative element has no reinforcement.

17. A set of at least two snow gliding boards as claimed in claim 1, wherein each of the gliding boards substantially comprise the same internal mechanical structuring beam and wherein each of the gliding boards are distinguished from one another in that the 3D decorative element of one of the gliding boards and the 3D decorative element of the other gliding board confer different shapes on the respective visible tops of the at least two gliding boards.

* * * * *